US009730505B2

(12) United States Patent
Jouan et al.

(10) Patent No.: US 9,730,505 B2
(45) Date of Patent: Aug. 15, 2017

(54) COSMETIC PRODUCT DISPENSER

(71) Applicant: QUALIPAC, Neuilly sur Seine (FR)

(72) Inventors: Frédéric Jouan, Neuilly sur Seine (FR); Alain Cambon, Naucelles (FR)

(73) Assignee: QUALIPAC, Neuilly sur Seine (FR)

( * ) Notice: Subject to any disclaimer, the term of this patent is extended or adjusted under 35 U.S.C. 154(b) by 0 days.

(21) Appl. No.: 14/760,705

(22) PCT Filed: Jan. 23, 2014

(86) PCT No.: PCT/FR2014/050130
§ 371 (c)(1),
(2) Date: Jul. 13, 2015

(87) PCT Pub. No.: WO2014/114885
PCT Pub. Date: Jul. 31, 2014

(65) Prior Publication Data

US 2015/0335134 A1 Nov. 26, 2015

(30) Foreign Application Priority Data

Jan. 24, 2013 (FR) ..... 1350618

(51) Int. Cl.

| | |
|---|---|
| ***B65D 83/00*** | (2006.01) |
| ***A45D 40/00*** | (2006.01) |
| ***A45D 34/00*** | (2006.01) |
| ***A45C 11/00*** | (2006.01) |
| ***A45D 40/10*** | (2006.01) |
| ***A45D 40/26*** | (2006.01) |
| ***A45D 40/06*** | (2006.01) |
| ***B43K 21/08*** | (2006.01) |
| ***A45D 34/04*** | (2006.01) |

(52) U.S. Cl.
CPC ..... *A45D 40/267* (2013.01); *A45D 34/045* (2013.01); *A45D 40/10* (2013.01); *A45D 40/265* (2013.01)

(58) Field of Classification Search
CPC ..... A45D 40/10; A45D 34/045; A45D 40/04; A45D 40/265
USPC ..... 401/127, 80, 53
See application file for complete search history.

(56) References Cited

U.S. PATENT DOCUMENTS

| | | | | |
|---|---|---|---|---|
| 3,380,795 A * | 4/1968 | Gruska | ..... | A45D 40/06 401/78 |
| 4,738,559 A * | 4/1988 | Gueret | ..... | A45D 40/06 401/68 |
| 4,812,066 A * | 3/1989 | Gueret | ..... | A45D 40/06 401/78 |

(Continued)

FOREIGN PATENT DOCUMENTS

| | | | | |
|---|---|---|---|---|
| EP | 1 741 364 A1 | 1/2007 | | |
| EP | 1741364 A1 * | 1/2007 | ..... | A45D 40/00 |
| FR | 2 865 910 A1 | 8/2005 | | |

*Primary Examiner* — David Walczak
*Assistant Examiner* — Thomas M Abebe
(74) *Attorney, Agent, or Firm* — Im IP Law; C. Andrew Im

(57) ABSTRACT

A cosmetic product dispenser includes a tubular container extending along a main axis and an application assembly. The application assembly includes a grip element, an applicator connected to the grip element; and a locking device to lock the application assembly in the container. The locking device moves from a storage position to a release position when the grip element is pressed in.

12 Claims, 6 Drawing Sheets

(56) References Cited

U.S. PATENT DOCUMENTS

| | | | | | |
|---|---|---|---|---|---|
| 5,102,249 | A * | 4/1992 | Holloway | A45D 40/10 | 401/116 |
| 5,399,040 | A * | 3/1995 | Holloway | A45D 40/06 | 401/78 |
| 2006/0131345 | A1* | 6/2006 | Liard | A45D 40/04 | 222/390 |
| 2007/0062978 | A1* | 3/2007 | Bruno | B65D 83/0011 | 222/390 |
| 2007/0172302 | A1* | 7/2007 | Milesi | A45D 40/265 | 401/126 |
| 2007/0274763 | A1* | 11/2007 | Domy | A45D 40/10 | 401/53 |
| 2009/0020551 | A1* | 1/2009 | Malvar | A45D 40/265 | 401/132 |
| 2010/0003064 | A1* | 1/2010 | Bouix | A45D 40/0087 | 401/121 |
| 2010/0104348 | A1* | 4/2010 | Rauschert | A45D 40/268 | 401/122 |
| 2012/0027499 | A1* | 2/2012 | Hermouet | A45C 11/008 | 401/55 |
| 2012/0282008 | A1* | 11/2012 | Geuther | A45D 40/26 | 401/122 |
| 2012/0301206 | A1* | 11/2012 | Pires | A45D 40/265 | 401/122 |
| 2013/0206161 | A1* | 8/2013 | Giancana | A45D 40/265 | 132/218 |
| 2014/0348566 | A1* | 11/2014 | Uehara | A45D 34/046 | 401/126 |
| 2015/0164210 | A1* | 6/2015 | Lou | A46B 9/021 | 401/129 |
| 2015/0173486 | A1* | 6/2015 | Weishaar | B43K 21/08 | 401/53 |
| 2016/0083153 | A1* | 3/2016 | Apodaca | A45D 34/045 | 401/129 |

* cited by examiner

COSMETIC PRODUCT DISPENSER

RELATED APPLICATIONS

This application is a §317application from PCT/FR2014/050130 filed Jan. 23, 2014, which claims priority from French Patent Application No. 13 50618 filed Jan. 24, 2013, each of which is herein incorporated by reference in its entirety.

TECHNICAL FIELD OF THE INVENTION

The invention relates to a cosmetic product dispenser, in particular to a lip gloss dispenser.

BACKGROUND OF THE INVENTION

Conventional lip gloss packaging generally comprises a bottle provided with a threaded neck onto which a cap is screwed. Said cap carries a stem provided with an applicator, for example of the brush type. When the cap is screwed onto the bottle, the stem and the applicator are contained in said bottle.

The use of the product thus involves manipulating the packaging in a screwing/unscrewing movement, which can seem annoying to the user and ill-suited to the luxury image of cosmetic products.

Moreover, the leaktightness of such a device depends on the degree of tightening of the two elements, which can vary significantly depending on the manufacturing tolerances of the components involved in this function, of which there are typically at least three. Depending on the degree of viscosity of the lip gloss, which is generally semi-liquid, a poorly screwed cap can result in leaks of product out of the bottle.

OBJECT AND SUMMARY OF THE INVENTION

The object of the invention is to propose an alternative to the known lip gloss packaging, providing simpler use hand movements and preferably ensuring optimal leaktightness of the packaging.

In particular, the object of the invention is to propose packaging having hand movements of the push-ejection type.

FR2865910 discloses packaging for lipstick in a case, the lipstick holder being released from the container by an axial push-ejection hand movement similar to the hand movements for retractable ball-point pens.

The ejection mechanism used comprises in particular a cam system having a heart-shaped track which guides two flexible tabs.

This system is disposed in the base of the lipstick holder. It is difficult to transfer to a lip gloss cap which, for ergonomic reasons, generally has a much smaller diameter than a lipstick holder base.

In order to make it possible to produce an axial ejection system that is robust, while having a small radial size, the invention relates to a cosmetic product dispenser comprising: a tubular case extending along a main axis; an application assembly that is able to move with respect to the container, said assembly comprising a gripping element and an applicator connected to the gripping element, these being such that, in a storage position, the applicator is housed inside the container; a volume for housing the product, located inside the container and/or inside the application assembly; locking means, such as a locking device, which, in the storage position, prevent any movement of the application assembly toward the outside of the container and, in a released position, allow the application assembly to be disconnected from the container; the locking means passing from the storage position to the released position when the gripping element is moved axially toward the container, from the storage position to a first depressed position; the locking means comprise an element that is able to rotate with respect to the applicator about the main axis, said rotary element and the gripping element comprising means that allow one to move with respect to the other along a loop path about the main axis, said path comprising a succession of portions that are oriented obliquely with respect to the main axis, two successive oblique portions having an opposite orientation along said main axis, ends of the oblique portions corresponding successively to the storage position, to the first depressed position and to the released position.

A "loop path" is understood to be a path that is closed on itself. Preferably, the rotary element and/or the gripping element comprise means that allow a single direction of travel on the loop path about the main axis.

The oblique portions of the path are for example approximately rectilinear segments that form what is referred to as a "sawtooth" path. However, one or more portions may have a slight curvature, forming an approximately sinusoidal path.

According to a preferred embodiment, the locking means pass from the released position to the storage position when the gripping element is moved axially toward the container, from the released position to a second depressed position. The hand movements for locking the device are therefore identical to the hand movements for unlocking.

In this case, the rotary element and the gripping element comprise means that allow one to move with respect to the other along a loop path about the main axis, said path comprising a succession of oblique portions, the ends of which correspond successively to the released position, to the second depressed position, to the storage position and to the first depressed position.

According to a preferred embodiment, the rotary element is a substantially cylindrical ring disposed along the main axis, said ring having, on an outer lateral surface, a groove that forms the loop path, a lug located on an inner lateral surface of the gripping element being able to slide in said groove.

BRIEF DESCRIPTION OF THE DRAWINGS

The invention will be understood better from reading the following description and from examining the accompanying figures. These are given by way of nonlimiting example of the invention. In the figures.

DETAILED DESCRIPTION OF THE EMBODIMENTS

Figure 1:
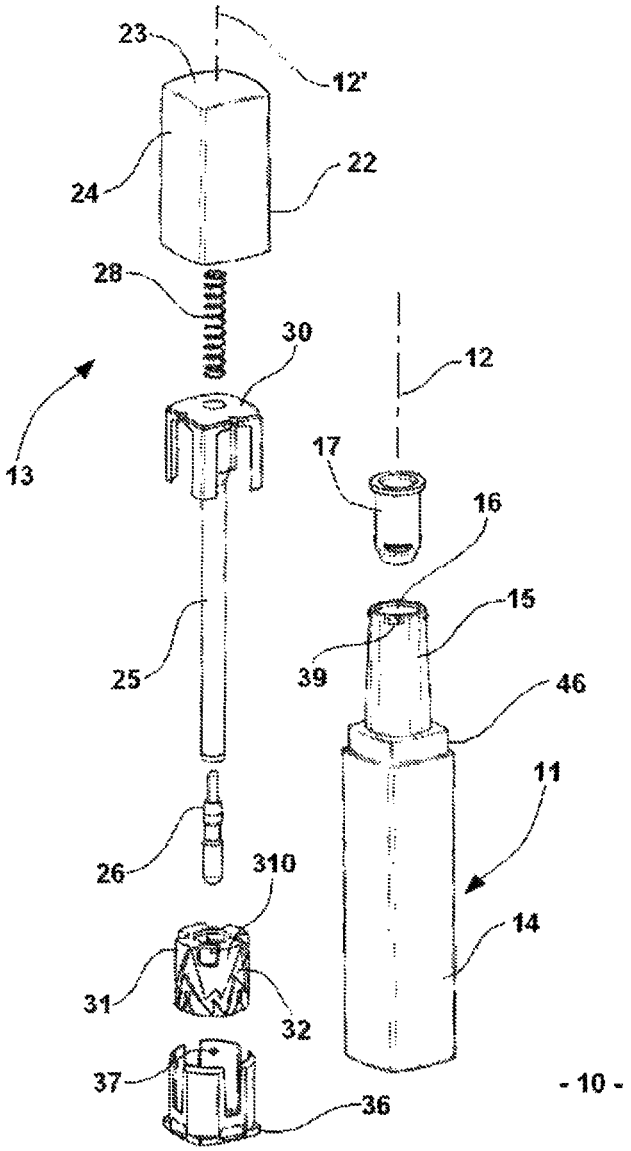
FIG. 1 shows an exploded view of a cosmetic product dispenser according to a first embodiment of the invention.

FIG. 1 shows an exploded view of a dispenser 10 according to a first embodiment of the invention. In this example, it is a dispenser for product of the lip gloss type.

Figure 2:
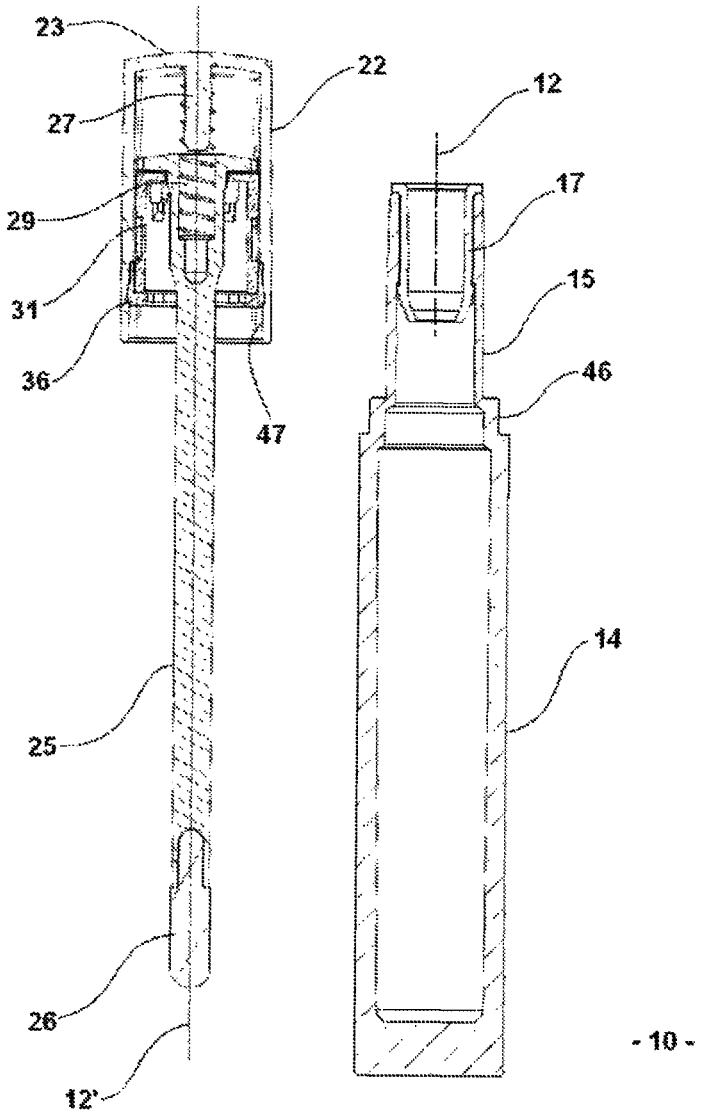
FIG. 2 shows a sectional view of the device from FIG. 1, in the disconnected position.

FIG. 2 shows a sectional view of the dispenser 10 from FIG. 1.

The dispenser 10 comprises in particular a tubular container 11 extending along a main axis 12. The dispenser 10 also comprises a product application assembly 13.

The assembly 13 is able to move with respect to the container 11 so as to be disconnected from said container in order to apply the product.

The assembly 13 is substantially disposed along an axis 12'. In an assembled position, such as in FIGS. 4 and 5, for example, the axes 12 and 12' are coincident. FIG. 1 and FIG. 2 show the container 11 and the assembly 13 in the disconnected position.

The container 11 comprises in particular a bottle 14 that serves as a product reservoir. The bottle 14 is surmounted by an elongate neck 15 of which an axial end that is away from the bottle comprises an orifice 16. Said orifice 16 provides access to the interior of the bottle 14. Inserted into said orifice is a part 17 made of plastics or rubber material, said part being substantially cylindrical and referred to as a wiper.

The application assembly 13 comprises in particular a gripping element 22. The element 22 has an end wall 23, the axis 12' forming an axis normal to a surface of said end wall. The element 22 also has a lateral gripping surface 24.

The gripping element 22 is connected to a stem 25 disposed along the axis 12'. One end of the stem 25 is equipped with a cosmetic product applicator 26. The applicator 26 is for example a brush or a flexible end piece made of foam or plastics material. In another embodiment, the applicator 26 may be a mascara brush or an eyeliner felt.

An inner surface of the end wall 23 of the gripping element 22 bears a peg 27, disposed along the axis 12', said peg 27 being visible in FIG. 2. One end of a helical spring 28 is fitted onto said peg 27. Another end of said spring 28 is secured to a cylindrical cavity 29 provided inside the stem 25, at the opposite end 30 from the applicator 26.

The oscillations of the spring 28 along the axis 12' allow the stem 25 to slide with respect to the gripping element 22.

Moreover, a rotary element, such as a ring 31 is able to rotate about the stem 25, inside the gripping element 22. The ring 31 is substantially in the form of a cylinder of revolution and has, on its outer lateral surface 310, a groove 32 that is closed on itself, defining a sawtooth-shaped loop path 32.

Figure 3A:
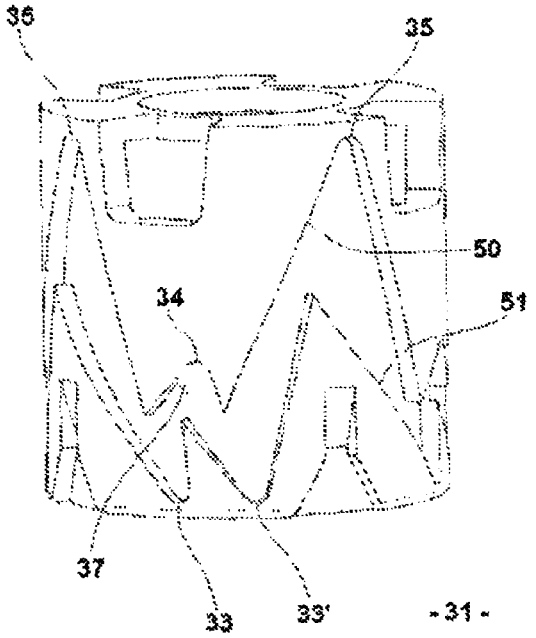
FIGS. 3A and 3B show views of a mechanical element of the device from FIGS. 1 and 2.
Figure 3B:
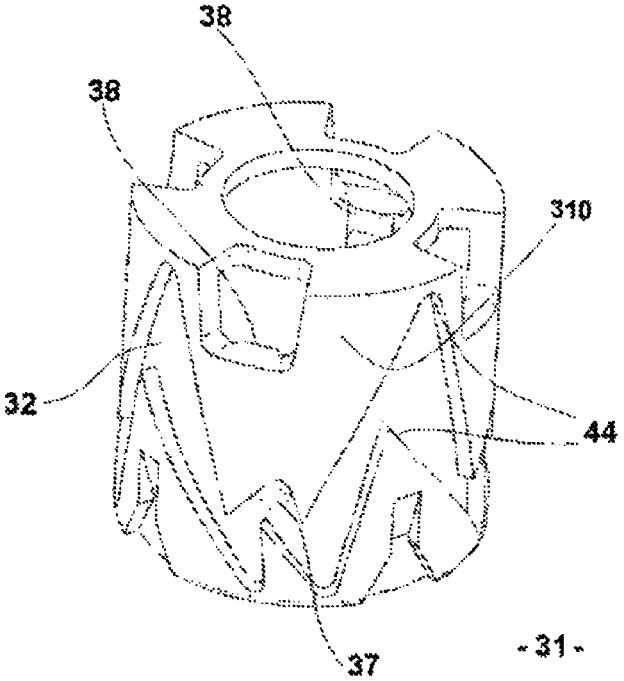

FIGS. 3A and 3B show perspective views of the ring 31. The apices or ends (33, 33') of the sawteeth or oblique portions that are oriented toward the applicator 26 are substantially disposed in a single plane at right angles to the axis 12'. By contrast, the apices or ends (34, 35) of the sawteeth or oblique portions that are oriented toward the end wall 23 of the element 22 are alternately disposed in two planes at right angles to the axis 12' and offset with respect to said axis.

A part referred to as an indexer 36 is secured to the end of the element 22 away from the end wall 23. The indexer 36 comprises at least one lug 37 protruding from an inner lateral surface of the element 22. The lug 37 is able to slide in the groove 32 in the ring 31. In the example in FIGS. 1 and 2, the indexer 36 comprises four lugs 37 that are substantially disposed in a single plane at right angles to the axis 12'.

When the oscillations of the spring 28 cause the stem 25 to slide with respect to the gripping element 22, the lugs 37 move in the sawtooth groove 32, thereby causing the ring 31 to rotate about the axis 12'.

The groove 32 is preferably provided with means 44 that prevent the lugs from moving in one of the directions of rotation of the ring 31. In the example in FIG. 3, the means 44 are formed by the respective disposition of the apices of each edge (50, 51) of the groove 32. This disposition results in the lugs being guided in a single direction of rotation of the ring.

Moreover, an inner lateral surface of the ring 31 has two catches 38 located opposite one another with respect to the axis 12'. These catches 38 are able to engage with catches 39 on an outer lateral surface of the neck 15, in the vicinity of the orifice 16. In the example, the neck 15 comprises four catches 39 that are substantially disposed in a single plane at right angles to the axis 12.

Figure 4:
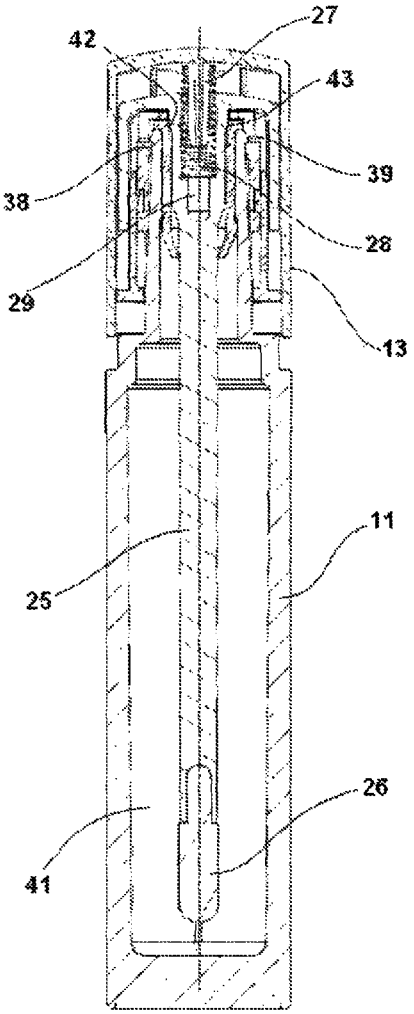
FIG. 4 shows a sectional view of the device from FIGS. 1 and 2, in the storage position.

FIG. 4 shows the device 10 in the storage position, the container 11 and the application assembly 13 being joined together.

In this storage position, the application assembly 13 is locked inside the container 11. More specifically, catches 39 on the neck 15 come into axial abutment against the catches 38 on the ring 31. This abutment prevents any movement of the assembly 13 toward the outside of the container 11. The contact under pressure between the catches (38, 39) is ensured by the compression of the spring 28.

In the storage position, the stem 25 and the applicator 26 are located inside the container. The applicator 26 is in particular housed in a volume 41 of the bottle 14, intended to contain the product to be applied.

In the example in FIG. 4, in the storage position, the gripping element 22 is located outside the container 11. Other possible variants will be described below.

In the storage position, the spring 28 is compressed compared with its position in FIG. 2, the peg 27 passing partially into the cavity 29 in the stem 25.

In addition, in the storage position, the lugs 37 on the indexer 36 are immobilized at the apices 34 of the groove 32 in the ring 31. Of the apices (34, 35) oriented toward the end wall 23, the apices 34 are closest to the apices (33, 33') that are oriented toward the applicator 26.

The leaktightness of the device 10 in the storage position is ensured by a frustoconical concave surface 42 of the wiper 17 being brought into contact with a frustoconical convex surface 43 of the stem 25. Preferably, the wiper 17 and the stem 25 are made of plastics materials. More preferably, the material of the wiper 17 is able to elastically deform in contact with the stem 25. The surfaces (42, 43) are kept firmly in contact with one another by the compression of the spring 28.

One of the advantages of this embodiment is that the compressive force between these two frustoconical surfaces, which ensures the leaktightness, is ensured by the compression of the spring 28. This force thus remains substantially constant regardless of the variations in tolerances of the various parts of the device 10.

According to one variant, the leaktightness is provided by an annular surface of the stem, perpendicular to the axis 12', bearing against a corresponding surface located at the upper end of the wiper 17. The leaktightness is thus ensured by planar and non-frustoconical surfaces.

Figure 5:
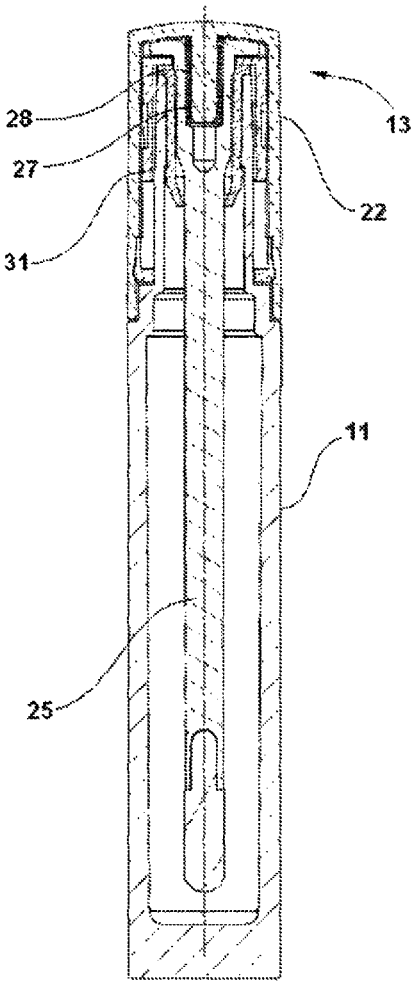
FIG. 5 shows a sectional view of the device from FIGS. 1 and 2, in the depressed position.

In order to release the application assembly 13 in order to use the product, a user of the device 10 can push the end wall 23 of the element 22 in the direction of the container 11. The assembly 13 is then moved into a first depressed position, as shown in FIG. 5.

The force exerted by the user has the effect of compressing the spring 28 compared with its position in FIG. 4. The element 22 moves with respect to the stem 25 such that the peg 27 passes completely into the cavity 29.

This axial movement of the element 22 with respect to the stem causes the lugs 37 on the indexer 36 to move in the groove 32 of the ring 31 until they come into abutment against the apices 33 that are oriented toward the applicator 26. At the same time, the ring 31 pivots about the stem 25.

When the user releases the pressure on the end wall 23, the spring 28 relaxes, causing the lugs 37 on the indexer 36 to move in the groove 32, while the ring 31 pivots about the stem 25.

The means 44 prevent the lugs 37 from returning toward the apices 34, said lugs 37 moving until they come into abutment against the apices 35 that are closest to the end wall 23. The angular position of the ring 31 is then such that the catches 38 do not come into abutment against the catches 39 of the neck 15. The assembly 13 is thus unlocked with respect to the container 11. The device 10 is in the released position, the assembly 13 and the container 11 each being in the configuration shown in FIG. 2.

The user can then disconnect the assembly 13 from the container 11 in order to use the product.

In the example in FIGS. 1 to 5, the apices 34 and 35 are not in the same position along the axis 12. In the released position, the gripping element 22 thus forms a greater projection with respect to the container 11 than in the storage position. Thus, there is no risk of the user confusing the two positions and storing the device 10 without having locked it beforehand.

However, according to one variant embodiment of the invention, it is possible to provide apices 34 and 35 that are substantially coplanar, the locking of the device 10 being signaled for example by a visual marking associated with the angular position of the ring 31.

According to another variant embodiment of the invention, when the device 10 is in the storage position, the applicator 26 is at a distance from the volume 41 holding the product. In the first depressed position, the applicator 26 is immersed in the product so as to be covered therewith as it passes to the released position.

After the product has been used, it is possible to return the device 10 to the storage position as described below: the user introduces the stem 25 into the container 11 and presses the assembly 13 in the direction of the bottle 14, as far as a second depressed position, analogous to the first depressed position in FIG. 5. The compression of the spring 28 causes the lugs 37 to move in the groove 32 in the direction allowed by the means 44, until they come into abutment against apices 33' that are oriented toward the applicator 26. When the user releases the pressure on the end wall 23, the relaxation of the spring 28 causes the lugs 37 to move again in order to come into abutment against apices 34.

The device 10, and in particular the ring 31, has then returned to an angular configuration equivalent to the one in FIG. 4. The bringing of the catches 39 on the neck 15 into abutment against the catches 38 on the ring 31 ensures that the device 10 is locked.

In order that the lock cannot be undone by simply rotating the assembly 13 about the axis 12 from the storage position, such rotation with respect to the container 11 should be prevented.

In the example described above, the neck 15 has a portion 46 with a square section, an inner surface 47 of the element 22 having a shape complementary to said portion 46. Other mechanical means for preventing the rotation are also possible.

Figure 6:
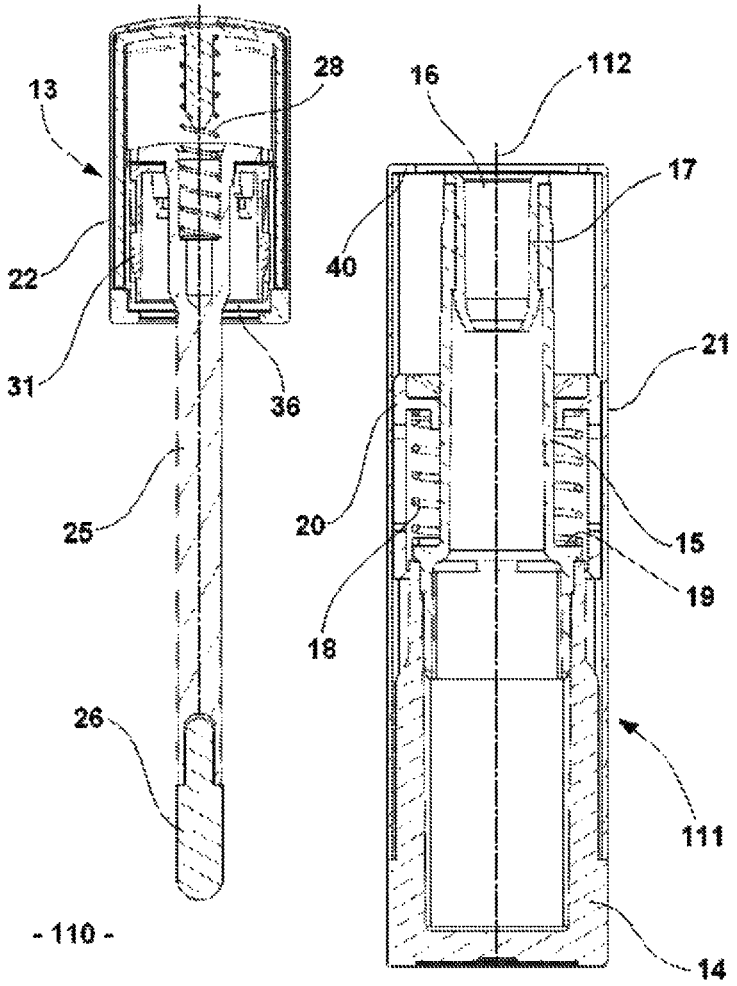
FIG. 6 shows a sectional view of a cosmetic product dispenser according to a second embodiment of the invention, in the disconnected position.
Figure 7:
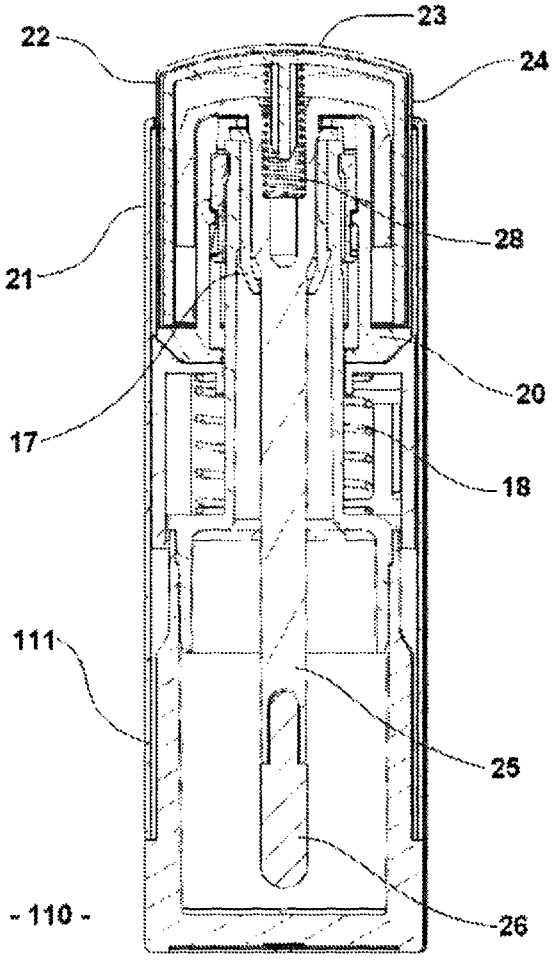
FIG. 7 shows a sectional view of the device from FIG. 6, in the storage position.

FIGS. 6 and 7 show a device 110 according to another embodiment of the invention. In the same way as the device 10, the device 110 is a lip gloss dispenser.

In the following description, the elements of the device 110 that are identical to those of the device 10 bear the same reference numerals.

The dispenser 110 has a tubular case 111 extending along a main axis 112. The dispenser 110 also has a product application assembly 13.

The above description of the assembly 13 of the device 10 applies to the assembly 13 of the device 110. Said assembly 13 has in particular a gripping element 22, a spring 28, a stem 25 and an applicator 26. The assembly 13 also has a ring 31 and an indexer 36. The ring 31 is identical to the one shown in FIG. 3 and described above.

The assembly 13 is able to move with respect to the case 111 so as to be disconnected from said case in order to apply the product. In FIG. 6, the assembly 13 and the case 111 are in the disconnected position.

The case 111 has in particular a bottle 14 that serves to hold product and is surmounted by a neck 15. A wiper 17 is inserted into an axial orifice 16 of the neck.

Disposed around the neck 15 is a helical spring 18, a first end of which bears against a shoulder 19 between the bottle 14 and said neck 15. A second end of the spring 18, which is able to move along the axis 112, is secured to a stop part 20. The stop part 20 is pierced by an orifice through which the neck 15 passes.

The stop part 20 can slide inside a jacket 21 of the case. The jacket 21 is substantially cylindrical along the axis 12. A part of said jacket is fitted around the bottle 14.

As is visible in FIG. 6, a stop 40, located at one axial end of the jacket 21, keeps the part 20 inside said jacket 21. Thus, the spring 18 is held partially compressed compared with its rest position.

FIG. 7 shows the device 110 in the storage position, the case 111 and the application assembly 13 being joined together.

In this storage position, the application assembly 13 is locked inside the case 111 by way of the same mechanism as described above between the assembly 13 and the container 11 of the device 10.

In the example in FIG. 7, in the storage position, the gripping element 22 is partially contained in the case 111, more specifically in the jacket 21. Said jacket and the element 22 have a square, not circular, section. Thus, accidental unlocking of the device by rotation of the element 13 about the axis 112 is avoided.

In the storage position, the end wall 23 of the element 22 and a part of the gripping surface 24 protrude from the case so as to make it easier for the user to act thereon in order to unlock the assembly 13. However, according to a variant embodiment, it is possible to configure the device 110 such that the assembly 13 is entirely held in the case 111 in the storage position.

In the storage position, the element 22 partially housed in the case 111 bears against the stop part 20, compressing the spring 18 with respect to its position in FIG. 6. The spring 28 of the assembly 13 is for its part also compressed, as described above for the device 10.

As in the preceding example, the leaktightness of the device 110 in the storage position is ensured by the wiper 17 being brought into contact with a surface of the stem 25.

In order to release the application assembly 13 in order to use the product, a user of the device 110 can push the end wall 23 of the element 22, this having the effect of pivoting the ring 31 of the assembly 13, as described above.

When the user releases the pressure on the end wall 23, the spring 18 of the case relaxes, pushing the part 20 and the gripping element 22 toward the outside of the case.

The spring 28 of the assembly 13 also relaxes, causing the ring 31 to pivot again, unlocking the assembly 13 and the case 111.

The device 110 is in the released position, and the assembly 13 and the case 111 are each in the configuration shown in FIG. 6. The user can then disconnect the assembly 13 from the case 111 in order to use the product.

The invention applies advantageously to lip gloss dispensers as described above. However, it is possible to apply it to other cosmetic or hygiene products, for example to dispensers for mascara, local care products, or lipstick.

The stem 25 of the above-described devices (10, 110) can in particular be replaced by a lipstick, or by a plastics cylinder protecting said stick, the stick being extracted by a conventional mechanism for rotating the gripping element 22 with respect to the cylinder.

According to another variant, the stem 25 can be replaced by a liquid product dispenser, of the spray type, the mechanism for dispensing said spray being housed in the container 11 in the storage position.

The invention claimed is:

1. A cosmetic product dispenser, comprising:
- a tubular container extending along a main axis;
- an application assembly configured to move with respect to the tubular container, the application assembly comprising:
  - a gripping element;
  - an applicator connected to the gripping element, the applicator is housed inside the tubular container in a storage position;
- a volume to house a cosmetic product, the volume is located inside the container;
- a locking device to prevent a movement of the application assembly toward outside of the container in a storage position and to allow the application assembly to be disconnected from the tubular container in a released position;
- the locking device passing from the storage position to the released position in response to a movement of the gripping element axially towards the tubular container from the storage position to a first depressed position;
- the locking device comprises a rotary element configured to rotate with respect to the gripping element about the main axis, the rotary element and the gripping element moves with respect to each other along a loop path about the main axis, the loop path comprises a succession of oblique portions that are oriented obliquely with respect to the main axis, two successive oblique portions having an opposite orientation along the main axis, ends of the oblique portions corresponding successively to the storage position, to the first depressed position and to the released position.

2. The cosmetic product dispenser as claimed in claim 1, wherein the locking device passes from the released position to the storage position in response to a movement of the gripping element axially towards the container from the released position to a second depressed position; and wherein the ends of the oblique portions correspond successively to the released position, to the second depressed position and to the storage position.

3. The cosmetic product dispenser as claimed in claim 1, wherein the rotary element is a substantially cylindrical ring disposed along the main axis, the cylindrical ring comprises a groove forming the loop path on an outer lateral surface and the gripping element comprises a lug located on an inner lateral surface configured to slide in the groove.

4. The cosmetic product dispenser as claimed in claim 1, wherein at least one of the rotary element or the gripping element is configured to allow a single direction of travel on the loop path about the main axis.

5. The cosmetic product dispenser as claimed in claim 1, wherein an orifice in the tubular container provides access to the volume to house the cosmetic product and comprises a concave frustoconical surface; wherein the gripping element comprises a convex frustoconical surface; and further comprising a helical spring to apply a pressure to keep the frustoconical surfaces in contact to ensure a leak-tightness of the cosmetic product dispenser in the storage position.

6. The cosmetic product dispenser as claimed in claim 1, wherein the volume is located inside the container and the application assembly.

7. A cosmetic product dispenser, comprising:
- a tubular container extending along a main axis;
- an application assembly configured to move with respect to the tubular container, the application assembly comprising:
  - a gripping element;
  - an applicator connected to the gripping element, the applicator is housed inside the container in a storage position;
- a volume to house a cosmetic product, the volume is located inside the application assembly;
- a locking device to prevent a movement of the application assembly toward outside of the container in a storage position and to allow the application assembly to be disconnected from the tubular container in a released position;
- the locking device passing from the storage position to the released position in response to the gripping element moving axially toward the tubular container from the storage position to a first depressed position;
- the locking device comprises a rotary element configured to rotate with respect to the gripping element about the main axis, the rotary element and the gripping element moves with respect to each other along a loop path about the main axis, the loop path comprises a succession of oblique portions that are oriented obliquely with respect to the main axis, two successive oblique portions having an opposite orientation along the main axis, ends of the oblique portions corresponding successively to the storage position, to the first depressed position and to the released position.

8. The cosmetic product dispenser as claimed in claim 7, wherein the locking device passes from the released position to the storage position in response to a movement of the gripping element axially towards the container from the released position to a second depressed position; and wherein the ends of the oblique portions correspond successively to the released position, to the second depressed position and to the storage position.

9. The cosmetic product dispenser as claimed in claim 7, wherein the rotary element is a substantially cylindrical ring disposed along the main axis, the cylindrical ring comprises a groove forming the loop path on an outer lateral surface and the gripping element comprises a lug located on an inner lateral surface configured to slide in the groove.

10. The cosmetic product dispenser as claimed in claim 7, wherein at least one of the rotary element or the gripping element is configured to allow a single direction of travel on the loop path about the main axis.

11. The cosmetic product dispenser as claimed in claim 7, wherein an orifice in the tubular container provides access to the volume to house the cosmetic product and comprises a concave frustoconical surface; wherein the gripping element comprises a convex frustoconical surface; and further comprising a helical spring to apply a pressure to keep the frustoconical surfaces in contact to ensure a leak-tightness of the cosmetic product dispenser in the storage position.

12. The cosmetic product dispenser as claimed in claim 7, wherein the volume is located inside the container and the application assembly.

* * * * *